US007315283B2

(12) United States Patent
Chang

(10) Patent No.: US 7,315,283 B2
(45) Date of Patent: Jan. 1, 2008

(54) DUAL-BAND CIRCULARLY POLARIZED ANTENNA

(75) Inventor: The-Nan Chang, Taipei (TW)

(73) Assignee: Tatung Company, Taipei (TW)

( * ) Notice: Subject to any disclaimer, the term of this patent is extended or adjusted under 35 U.S.C. 154(b) by 4 days.

(21) Appl. No.: 11/487,377

(22) Filed: Jul. 17, 2006

(65) Prior Publication Data

US 2007/0236390 A1 Oct. 11, 2007

(30) Foreign Application Priority Data

Apr. 6, 2006 (TW) ..... 95112155 A

(51) Int. Cl.
*H01Q 1/38* (2006.01)

(52) U.S. Cl. ..... 343/700 MS; 343/770; 343/840; 343/846; 343/853; 343/892; 343/912

(58) Field of Classification Search ..... 343/700 MS, 343/767, 770, 840, 846, 848, 853, 893, 912
See application file for complete search history.

(56) References Cited

U.S. PATENT DOCUMENTS

| | | | | |
|---|---|---|---|---|
| 4,053,895 A | | 10/1977 | Malagisi | 343/700 MS |
| 4,684,952 A | | 8/1987 | Munson et al. | 343/700 MS |
| 6,084,548 A | * | 7/2000 | Hirabe | 343/700 MS |
| 6,091,365 A | | 7/2000 | Derneryd et al. | 343/700 MS |
| 6,195,047 B1 | | 2/2001 | Richards | 343/700 MS |
| 6,657,592 B2 | * | 12/2003 | Dening et al. | 343/700 MS |
| 7,026,998 B2 | * | 4/2006 | Chang et al. | 343/700 MS |
| 7,095,373 B2 | * | 8/2006 | Aikawa et al. | 343/700 MS |
| 7,138,949 B1 | * | 11/2006 | Ryken et al. | 343/700 MS |
| 7,145,518 B2 | * | 12/2006 | Tanaka et al. | 343/909 |

FOREIGN PATENT DOCUMENTS

| | | |
|---|---|---|
| JP | P3006867 | 11/1999 |
| JP | P2001-512640 A | 8/2001 |

* cited by examiner

*Primary Examiner*—Douglas W. Owens
*Assistant Examiner*—Chuc Tran
(74) *Attorney, Agent, or Firm*—Bacon & Thomas PLLC

(57) ABSTRACT

A dual-band circularly polarized antenna is disclosed, more particularly a dual-band circularly polarized antenna being able to transmit and receive circularly polarized signals at two different frequency bands, simultaneously. The dual-band circularly polarized antenna of the present invention comprises a first polarized radiating element with at least one corner being chamfered, a plurality of second polarized radiating elements with each of the second polarized radiating elements having at least one corner being chamfered, a signal distributor for distributing an electrical signal, a signal coupling unit electrically connecting with the first polarized radiating unit and the signal distributor, and a ground plate. The dual-band circularly polarized antenna of the present invention not only can be manufactured with a low cost, but also has a simpler structure. As a result, the dual-band circularly polarized antenna of the present invention can be easily integrated into the antenna module of an RFID system.

16 Claims, 7 Drawing Sheets

PRIOR ART

DUAL-BAND CIRCULARLY POLARIZED ANTENNA

BACKGROUND OF THE INVENTION

1. Field of the Invention

The present invention relates to a dual-band circularly polarized antenna and, more particularly, to a dual-band circularly polarized antenna that can transmit and receive circularly polarized signals at two different frequency bands simultaneously.

2. Description of Related Art

The antenna modules used in certain fields of application, such as the antenna module of an RFID system, of a base station of a mobile communication system or of a satellite communication system, are required to transmit and receive circularly polarized signals in two different frequency bands simultaneously. However, the circularly polarized antenna that are currently being used only can transmit and receive circularly-polarized signals in one single frequency band at a time, rather than in two different frequency bands. Although some kinds of existing dual-band antennas can transmit signals in two frequency bands simultaneously, the signals transmitted can only have the characteristics of linear polarization. That is, the existing dual band antenna is still unable to transmit and receive circularly polarized signals in two frequency bands at the same time. As a result, the existing type of dual-band antenna can only serve as a 'dual-band linear polarized antenna' rather than a 'dual-band circularly polarized antenna'.

FIG. 1A is a perspective view of a prior art dual-band linear polarized antenna, which is able to transmit and receive linear polarized signals simultaneously within the UHF band (between 860 MHz and 930 MHz) and the microwave band (between 2.45 GHz and 2.55 GHz). The antenna comprises a first linear polarized radiating element 11, four second linear polarized radiating elements 121, 122, 123, 124 and a ground plate 13. For brevity, the first microwave substrate on which the first linear polarized radiating element 11 is formed and the second microwave substrate on where the second linear polarized radiating elements 121, 122, 123, 124 are formed are omitted in the figure.

Both the first microwave substrate and the second microwave substrate are made of an FR-4 microwave substrate, and both the first microwave substrate and the second microwave substrates are 1.6 mm thick. To assemble the prior art dual-band linear polarized antenna, the first microwave substrate shall be placed on the surface of the second microwave substrate. Then, the second microwave substrate and the first microwave substrate thereon are placed on the upper surface 131 of the ground plate 13 made of metallic material, as shown in FIG. 1B.

As shown in FIG. 1A, the straight-line shaped signal coupling unit 14 is electrically connected with the first linear polarized radiating element 11 and an adapter 15, and the prior art dual-band linear polarized antenna is electrically connected with a signal processing unit (not shown) by a coaxial cable (not shown) being attached to the adapter 15. As a result, the prior art dual-band linear polarized antenna can transform an electrical signal from the signal processing unit (not shown) into two linear polarized signals at two respective frequency bands. The two linear polarized signals are then transmitted into the ambient environment (transmitting state). On the other hand, the prior art dual-band linear polarized antenna can receive linear polarized signals of any kind of frequency bands and transform these signals into corresponding electrical signals. The electrical signals are then provided to the signal processing unit for subsequent signal processing steps (receiving state). That is, the prior art dual-band linear polarized antenna can neither transmit nor receive any circularly polarized signals.

The industry, therefore, is still in the search for a dual-band circularly polarized antenna, which is able to transmit and receive circularly polarized signals simultaneously at two different frequency bands for improving the efficiency and widening the range of applications that an antenna module could offer.

SUMMARY OF THE INVENTION

The present invention provides a dual-band circularly polarized antenna, which comprises a first polarized radiating element having at least one chamfered corner, a plurality of second polarized radiating elements, each of which having at least one chamfered corner, a signal distributor for distributing an electrical signal, a signal coupling unit being electrically connected with the first polarized radiating element and the signal distributor respectively, and a ground plate. In operation, as the dual-band circularly polarized antenna of the present invention is in a transmitting state, the electrical signal is transmitted to the first polarized radiating element and the second polarized radiating elements by the signal distributor and the signal coupling unit therethrough. The first polarized radiating element and the second polarized radiating elements then transform that electrical signal into a first circularly polarized signal and a second circularly polarized signal respectively. As the dual-band circularly polarized antenna of the present invention is in a receiving state, the first circularly polarized signal and the second circularly polarized signal are received by the first polarized radiating element and the second polarized radiating elements, and the first circularly polarized signal and the second circularly polarized signal are transformed into the electrical signal, the electrical signal is then transmitted through the signal coupling unit to the signal distributor.

Therefore, by simply applying 'chamfered-corner treatment' on the corners of the first polarized radiating element and each of the second polarized radiating elements, the dual-band circularly polarized antenna of the present invention is able to transmit and receive the circularly polarized signals at two different frequency bands, i.e. the first circularly polarized signal and the second circularly polarized signal, at two different frequency bands at the same time.

Besides, by adjusting the side-length of the first polarized radiating element and each of the second polarized radiating elements of the dual-band circularly polarized antenna of the present invention, the frequency bands of the first circularly polarized signal and the second circularly polarized signal can be modulated. Further, the polarization direction (right-handed circularly polarized or left-handed circularly polarized) of the first circularly polarized signal and the second circularly polarized signal can also be modulated by choosing which of the corners of the first polarized radiating element and each of the second polarized radiating elements is to be chamfered, in order to meet the different performance requirements of different application circumstances.

Hence, by properly selecting the side-length and the corners to be chamfered of the first polarized radiating element and each of the second polarized radiating elements, the dual-band circularly polarized antenna of the present invention can not only transmit and receive two circularly polarized signals simultaneously at two different frequency bands, but also meet the different performance requirements of different application circumstances.

Additionally, for the application circumstances in which the transmission and reception of two circularly polarized signals at different frequency bands is required, such as the antenna module of an RFID system, the dual-band circularly polarized antenna of the present invention can significantly simplify the structure and minimize the manufacturing cost thereof, especially compared with the conventional solution, i.e., by using two single-band circularly polarized antennas operating at different frequency bands). Therefore, the dual-band circularly polarized antenna of the present invention can be easily integrated with any kind of antenna module of which the dimension is limited, and the application field of the dual-band circularly polarized antenna of the present invention is thus widened.

The dual-band circularly polarized antenna of the present invention can have any quantity of the second polarized radiating elements, but preferably the quantity is between 2 and 8, and the most preferable quantity is 4. The dual-band circularly polarized antenna of the present invention can have the second polarized radiating elements in any kind of shape, but preferably the shape of the second polarized radiating elements is a rectangle, a circle, an oval or a square. The dual-band circularly polarized antenna of the present invention can have the first polarized radiating element in any kind of shape, but preferably the shape of the first polarized radiating element is a rectangle, a circle, an oval or a square. The signal coupling unit of the dual-band circularly polarized antenna of the present invention can be made of a conducting material in any kind of shape, but preferably the shape of the conducting material is a straight rod.

The first polarized radiating element of the dual-band circularly polarized antenna of the present invention can have any of its corners chamfered, but preferably two of its corners positioned at a first diagonal are chamfered. Each of the second polarized radiating elements of the dual-band circularly polarized antenna of the present invention can have any of its corners chamfered, but preferably two of its corners positioned at a second diagonal are chamfered. The first bevel (i.e. the extending direction of the first diagonal) of the first polarized radiating element and the second bevel (i.e. the extending direction of the second diagonal) of each of the second polarized radiating elements of the dual-band circularly polarized antenna of the present invention can be arrayed in any kind of arrangement, but preferably the first bevel is parallel or perpendicular to the second bevel. The first polarized radiating element of the dual-band circularly polarized antenna of the present invention can be formed on a printed circuit board made of any kind of material, but preferably the first polarized radiating element of the dual-band circularly polarized antenna of the present invention is formed on an FR-4 microwave substrate, a Duroid™ microwave substrate or a Teflon™ microwave substrate. The second polarized radiating elements of the dual-band circularly polarized antenna of the present invention can be formed on a printed circuit board made of any kind of material, but preferably the second polarized radiating elements of the dual-band circularly polarized antenna of the present invention are formed on an FR-4 microwave substrate, a Duroid™ microwave substrate or a Teflon™ microwave substrate.

The first microwave substrate, the second microwave substrate and the ground plate of the dual-band circularly polarized antenna of the present invention can be stacked in any kind of arrangement, but preferably the first microwave substrate is placed between the ground plate and the second microwave substrate, or the second microwave substrate is placed between the ground plate and the first microwave substrate. The dual-band circularly polarized antenna of the present invention can have a ground plate made of any kind of material, but preferably the ground plate is made of metal, most preferably the ground plate is made of copper. The signal coupling distributor of the dual-band circularly polarized antenna of the present invention can be connected with any kind of signal line, but preferably the signal coupling distributor of the dual-band circularly polarized antenna of the present invention is connected with a coaxial cable or a copper strand wire. The dual-band circularly polarized antenna of the present invention can transmit and receive a first circularly polarized signal at any kind of frequency band, but preferably the first circularly polarized signal is at a frequency band ranging from 830 MHz to 930 MHz. The dual-band circularly polarized antenna of the present invention can transmit and receive a second circularly polarized signal at any kind of frequency band, but preferably the second circularly polarized signal is at a frequency band ranging from 2.45 GHz to 2.55 GHz. The dual-band circularly polarized antenna of the present invention can be applied in any kinds of application circumstances, but preferably the dual-band circularly antenna of the present invention is applied in the antenna modules of an RFID system, the antenna modules of the base station of a mobile communication system or the antenna modules of a satellite communication system.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
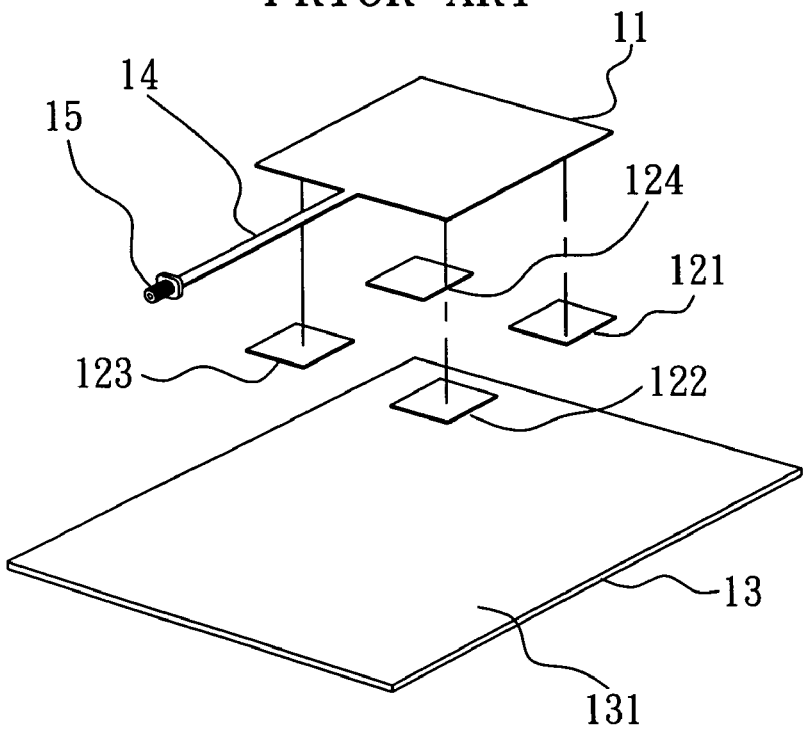
FIG. 1A PRIOR ART
FIG. 1A is a perspective view of a prior art dual-band linear polarized antenna.
Figure 1B:
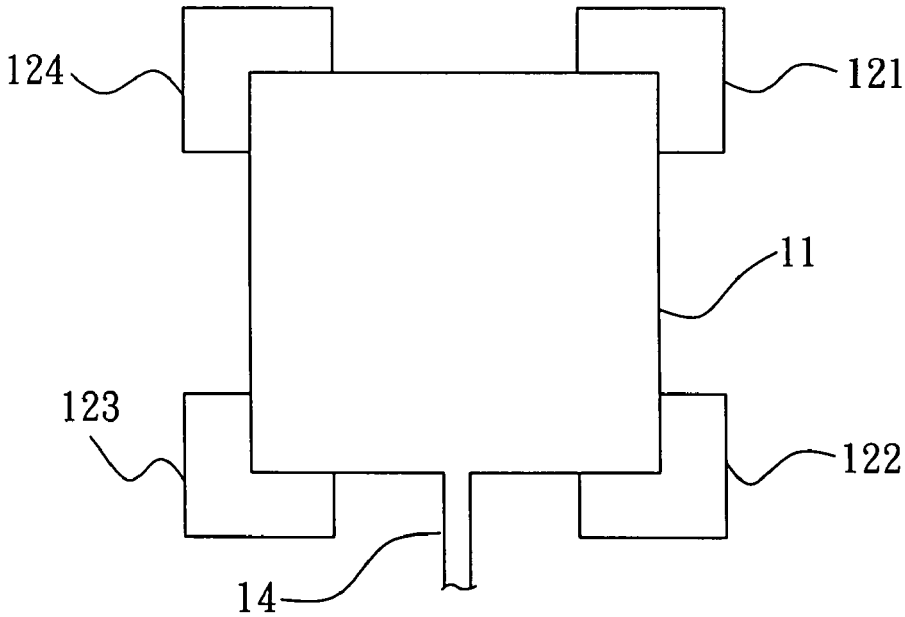
FIG. 1B is a schematic diagram illustrating the dual-band circularly polarized antenna of the prior art during its operation.
Figure 2A:
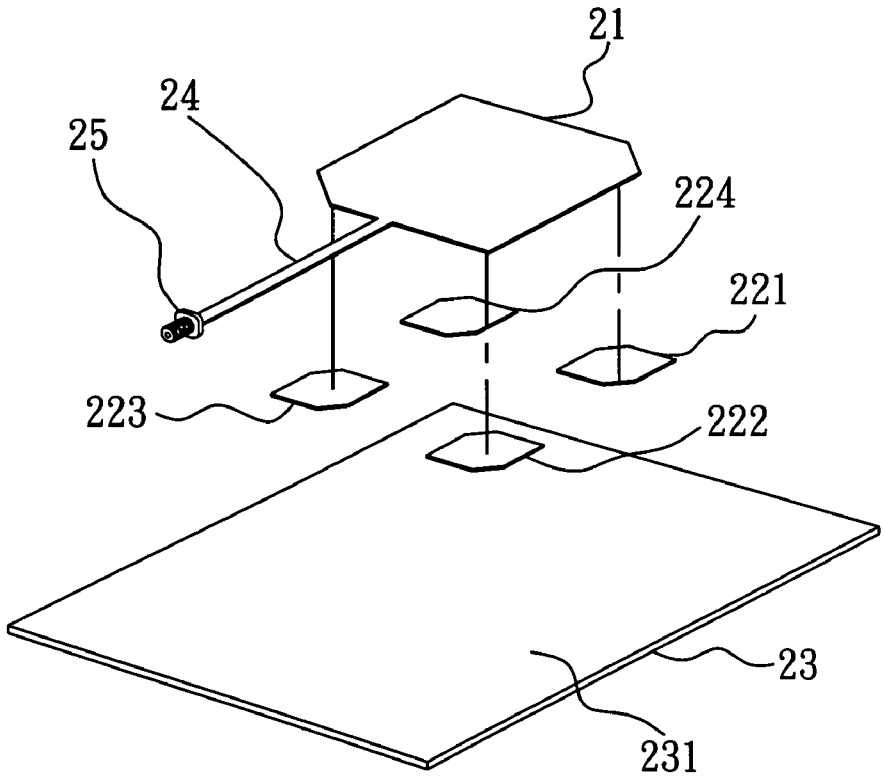
FIG. 2A is a perspective view of a dual-band circularly polarized antenna according to the first preferred embodiment of the present invention.

FIG. 2A is a perspective view of a dual-band circularly polarized antenna according to the first preferred embodiment of the present invention. The dual-band circularly polarized antenna is integrated into an antenna module for an RFID system, which is able to transmit and receive circularly polarized signals in the UHF frequency band (between 860 MHz and 930 MHz) and in the microwave frequency band (between 2.45 GHz and 2.55 GHz) simultaneously. As shown in FIG. 2A, the dual-band circularly polarized antenna according to the first preferred embodiment of the invention comprises a first polarized radiating element 21, four second polarized radiating elements 221, 222, 223, 224 and a ground plate 23. For brevity, the first microwave substrate on where the first polarized radiating element 21 is formed and the second microwave substrate on where the second polarized radiating elements 221, 222, 223, 224 are formed are omitted in the figure.

To assemble the dual-band circularly polarized antenna according to the first preferred embodiment of the present invention, the first microwave substrate (not shown) shall first be placed on the surface of the second microwave substrate (not shown). Then, the second microwave substrate and the first microwave substrate thereon are then placed on the upper surface 231 of the ground plate 23 made of metallic material. Both the first microwave substrate and the second microwave substrates are made of an FR-4 microwave substrate and have a thickness of 1.6 mm.

As shown in FIG. 2A, a straight-line shaped signal coupling unit 24 is electrically connected with the first polarized radiating element 21 and an adapter 25, and the dual-band circularly polarized antenna according to the first preferred embodiment of the present invention is electrically connected with a signal processing unit (not shown) by a coaxial cable (not shown) being attached to the adapter 25. Thus, the dual-band circularly polarized antenna according to the first preferred embodiment of the present invention can transform an electrical signal from the signal processing unit (not shown) into two circularly polarized signals, i.e. the first circularly polarized signal and the second circularly polarized signal, at two respective frequency bands. After the transformation, the two circularly polarized signals are transmitted into the ambient environment (i.e. the dual-band circularly polarized antenna according to the first preferred embodiment of the present invention is in its transmitting state). On the other hand, the first polarized radiating element and the second polarized radiating elements of the dual-band circularly polarized antenna according to the first preferred embodiment of the present invention can receive circularly polarized signals of any kinds of frequency bands in the environment and transform the circularly polarized signals into corresponding electrical signals. The electrical signals are then provided to the signal processing unit (not shown) for subsequent signal processing steps (i.e. the dual-band circularly polarized antenna according to the first preferred embodiment of the present invention is in its receiving state).

Figure 2B:
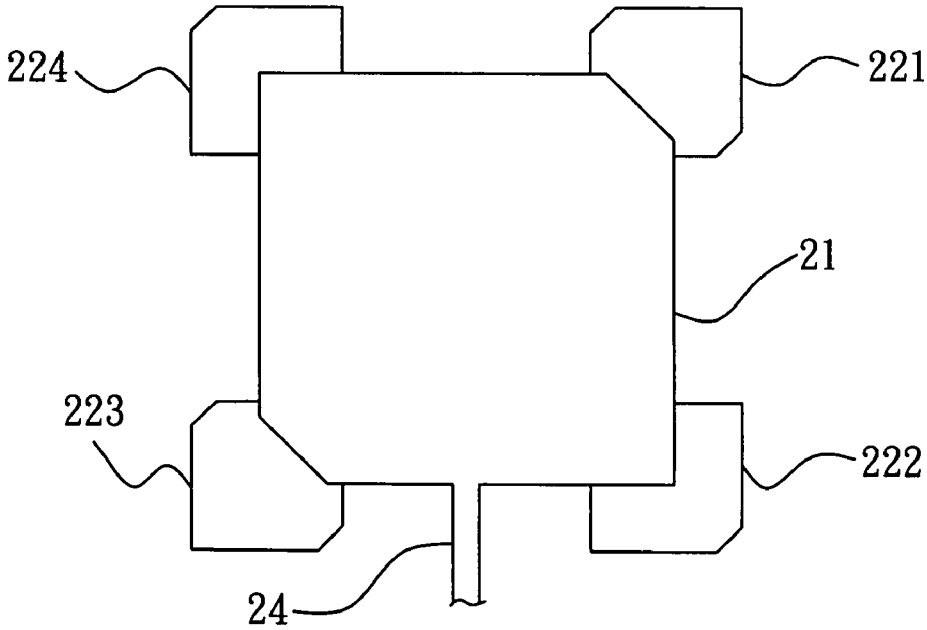
FIG. 2B is a schematic diagram of the dual-band circularly polarized antenna during its operation according to the first preferred embodiment of the present invention.

FIG. 2B is aschematic diagram of the dual-band circularly polarized antenna during its operation according to the first preferred embodiment of the present invention. The first polarized radiating element 21 is 72 mm long and 72 mm wide, and the four second polarized radiating elements 221, 222, 223, 224 share the identical size of 27 mm in length and 27 mm in width. As also shown in FIG. 2B, the first polarized radiating element 21 and the four second polarized radiating elements 221, 222, 223, 224 are all chamfered, such that the first bevel (the bottom left and the upper right corners of the first polarized radiating element 21, being located on the first diagonal are chamfered) are perpendicular to the second bevels (the bottom right and the upper left corners of each of the four second polarized radiating elements 221, 222, 223, 224, being located on second diagonal are chamfered).

Therefore, the dual-band circularly polarized antenna according to the first preferred embodiment of the present invention can transmit the first circularly polarized signals with the right-handed circularly polarization (the frequency of which is approximate to 900 MHz) and the second circularly polarized signals (the frequency of which is approximate to 2.45 GHz) with the left-handed circularly polarization simultaneously in its transmitting state. Also, when the dual-band circularly polarized antenna according to the first preferred embodiment of the present invention is in its receiving state, it can receive either the first circularly polarized signal or the second circularly polarized signal transmitted in the ambient environment. Moreover, after executing certain signal processing steps, the dual-band circularly polarized antenna according to the first preferred embodiment of the present invention can even receive both the first circularly polarized signal or the second circularly polarized signal simultaneously.

Figure 3A:
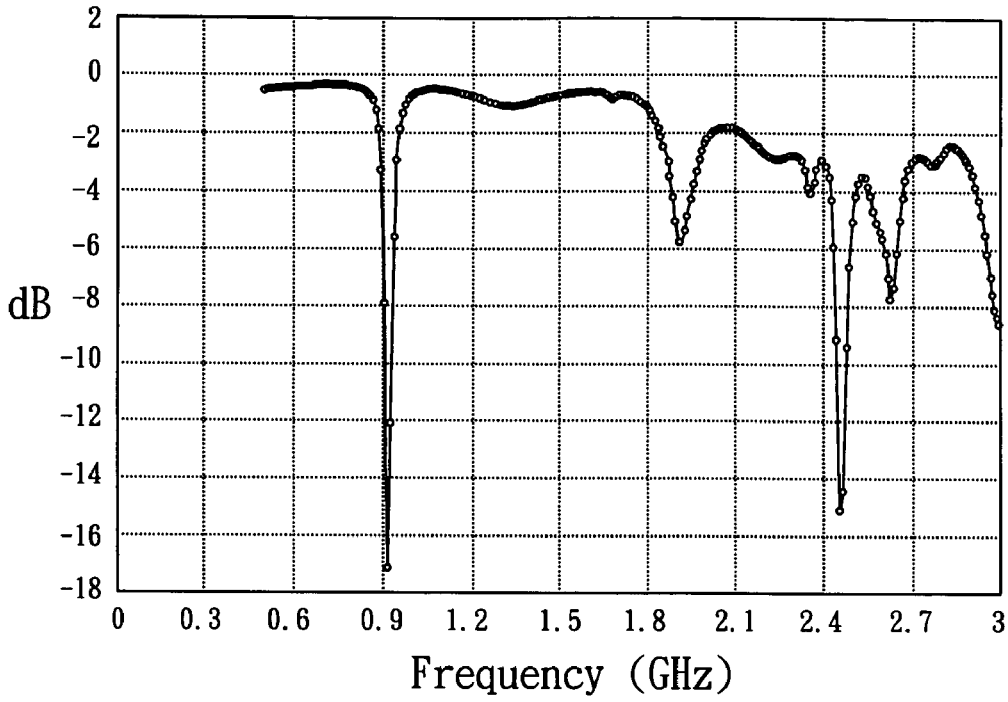
FIG. 3A is the transmission spectrum of the dual-band circularly polarized antenna according to the first embodiment of the present invention, as a result of the simulation performed with the IE3D software.
Figure 3B:
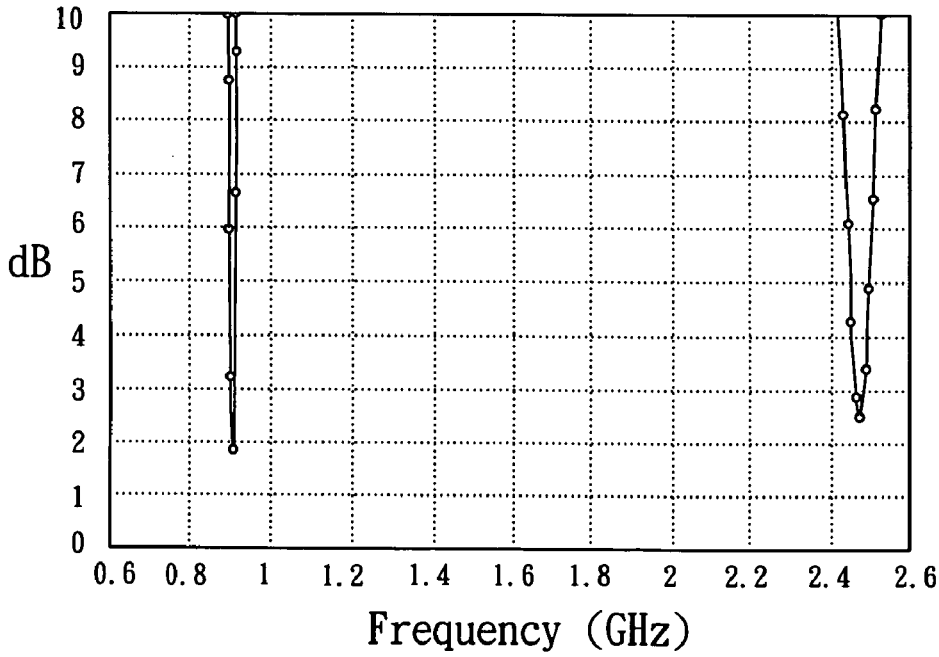
FIG. 3B is the transmission spectrum of the axial ratio of the circularly polarized signals transmitted by the dual-band circularly polarized antenna according to the first embodiment of the present invention, as a result of the simulation performed with the IE3D software.

FIG. 3A is the transmission spectrum of the dual-band circularly polarized antenna according to the first embodiment of the present invention, as a result of the simulation performed with the IE3D software. As described by the results of the simulation, the dual-band circularly polarized antenna according to the first embodiment of the present invention shall be able to transmit signals at two different frequency bands simultaneously, one of them is close to 900 MHz, while the other one is close to 2.45 GHz. FIG. 3B is the transmission spectrum of the axial ratio of the circularly polarized signals transmitted by the dual-band circularly polarized antenna according to the first embodiment of the present invention, as a result of the simulation performed with the IE3D software. The spectrum of FIG. 3B reveals that at these respective frequency bands, the axial ratio of the signals being transmitted by the dual-band circularly polarized antenna according to the first embodiment of the present invention can be lowered to 3 dB at the same time. That is to say, the two signals at these two frequency bands shall both have a 3-dB bandwidth that is greater than zero, which implies that these two signals shall have the characteristics of circular polarization. Therefore, the above simulated results shown in FIG. 3A and FIG. 3B reveal that the dual-band circularly polarized antenna according to the first preferred embodiment of the present invention shall be able to transmit signals having the characteristics of circular polarization simultaneously at two frequency bands (close to 900 MHz and 2.45 GHz, respectively), i.e. the first circularly polarized signal and the second circularly polarized signal.

Figure 4A:
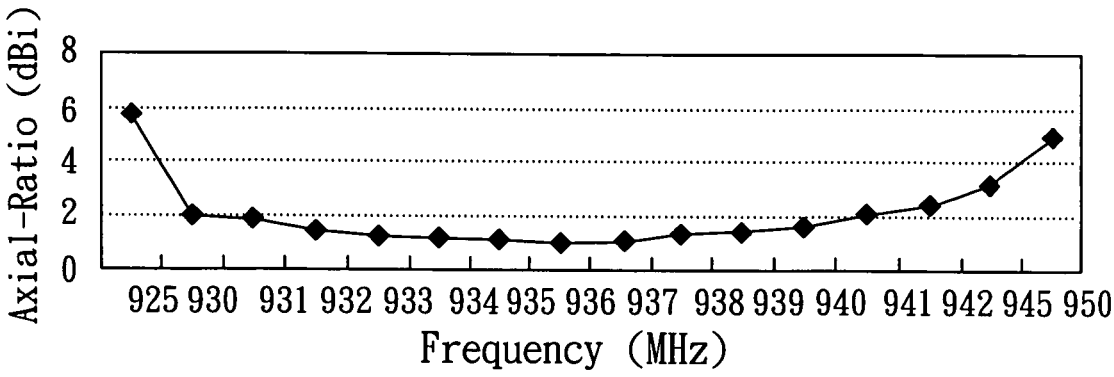
FIG. 4A is a diagram illustrating the measured result of the relation between the axial ratio and the frequency of the signals transmitted by the dual-band circularly polarized antenna according to the first preferred embodiment of the present invention, within the frequency range between 920 MHz and 950 MHz.
Figure 4B:
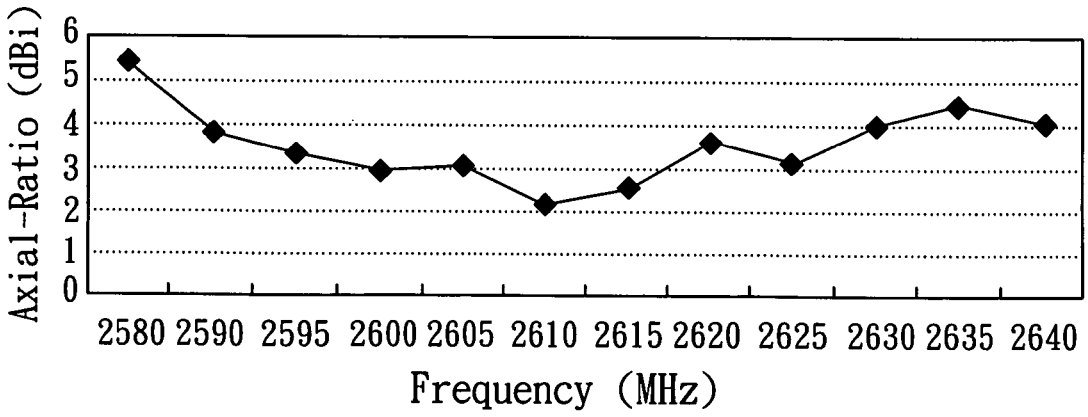
FIG. 4B is a diagram illustrating the measured result of the relation between the axial ratio and the frequency of the signals transmitted by the dual-band circularly polarized antenna according to the first preferred embodiment of the present invention, within the frequency range between 2580 MHz (2.58 GHz) and 2640 MHz (2.64 GHz).

Moreover, the dual-band circularly polarized antenna according to the first preferred embodiment of the present invention is placed in a non-reflection laboratory, in order to measure the actual characteristics of the signals transmitted by it. The measured results are shown both in FIG. 4A and FIG. 4B. FIG. 4A illustrates the measured result of the relation between the axial ratio and the frequency of the signals transmitted by the dual-band circularly polarized antenna according to the first preferred embodiment of the present invention, within the frequency range between 920 MHz and 950 MHz. FIG. 4B illustrates the measured result of the relation between the axial ratio and the frequency of the signals transmitted by the dual-band circularly polarized antenna according to the first preferred embodiment of the present invention, within the frequency range between 2580 MHz (2.58 GHz) and 2640 (2.64 GHz) As shown in the measured results above, it is confirmed that the dual-band circularly polarized antenna according to the first preferred embodiment of the present invention can transmit signals having circular polarization at two frequency bands simultaneously, close to 900 MHz and 2.45 GHz respectively.

Therefore, by combining both the results of the IE3D simulation and of the actual measurements, it is proven positively that the dual-band circularly polarized antenna according to the first preferred embodiment of the present invention can transmit signals having circular polarization (3-dB bandwidth is greater than zero), at two frequency bands simultaneously.

Figure 5A:
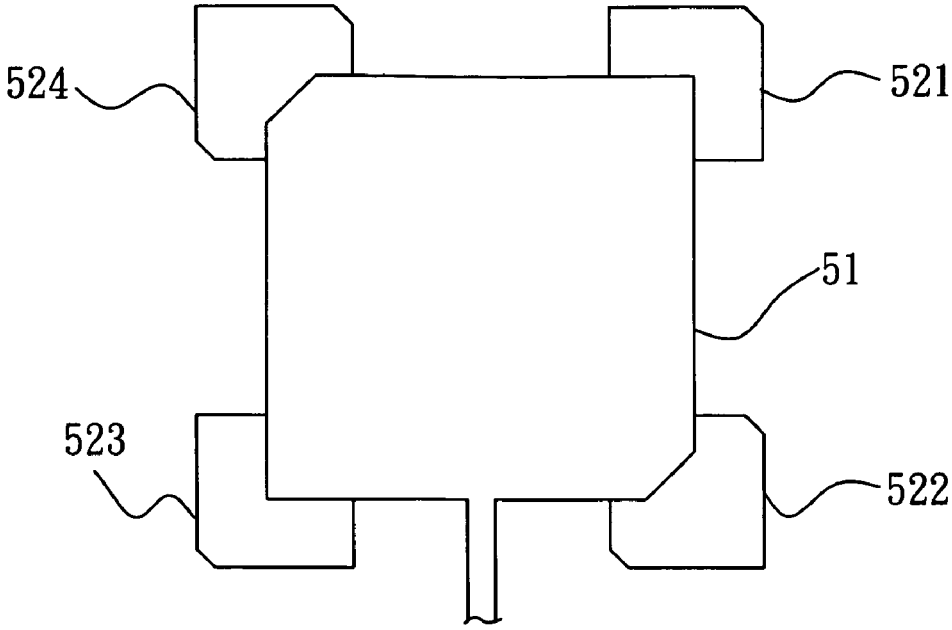
FIG. 5A is a schematic diagram of the dual-band circularly polarized antenna during its operation according to the second preferred embodiment of the present invention.

FIG. 5A is a schematic diagram of the dual-band circularly polarized antenna during its operation according to the second preferred embodiment of the present invention. The structure of the dual-band circularly polarized antenna during its operation according to the second preferred embodiment of the present invention is similar to that of the dual-band circularly polarized antenna according to the first preferred embodiment of the present invention. In the dual-band circularly polarized antenna during its operation according to the second preferred embodiment of the present invention, the first polarized radiating element 51 is 72 mm long and 72 mm wide, and the four second polarized radiating elements 521, 522, 523, 524 share the identical size of 27 mm in length and 27 mm in width.

As shown in FIG. 5A, the first polarized radiating element 51 and the four second polarized radiating elements 521, 522, 523, 524 thereunder are all chamfered, such that the first bevel (the bottom right and the upper left corners of the first polarized radiating elements 51, being located on the first diagonal are chamfered) are perpendicular to the second bevels (the bottom left and the upper right corners of each of the four second polarized radiating elements 521, 522, 523, 524, being located on the second diagonal are chamfered).

Therefore, the dual-band circularly polarized antenna according to the second preferred embodiment of the present invention can transmit the first circularly polarized signals with the left-handed circularly polarization (the frequency of which is approximate to 900 MHz) and the second circularly polarized signals (the frequency of which is approximate to 2.45 GHz) with the right-handed circularly polarization simultaneously in its transmitting state. Also, when the dual-band circularly polarized antenna according to the second preferred embodiment of the present invention is in its receiving state, it can receive either the first circularly polarized signals or the second circularly polarized signals transmitted in the ambient environment. Moreover, after executing certain signal processing steps, the dual-band circularly polarized antenna according to the second preferred embodiment of the present invention can even receive both the first circularly polarized signal or the second circularly polarized signal simultaneously.

Figure 5B:
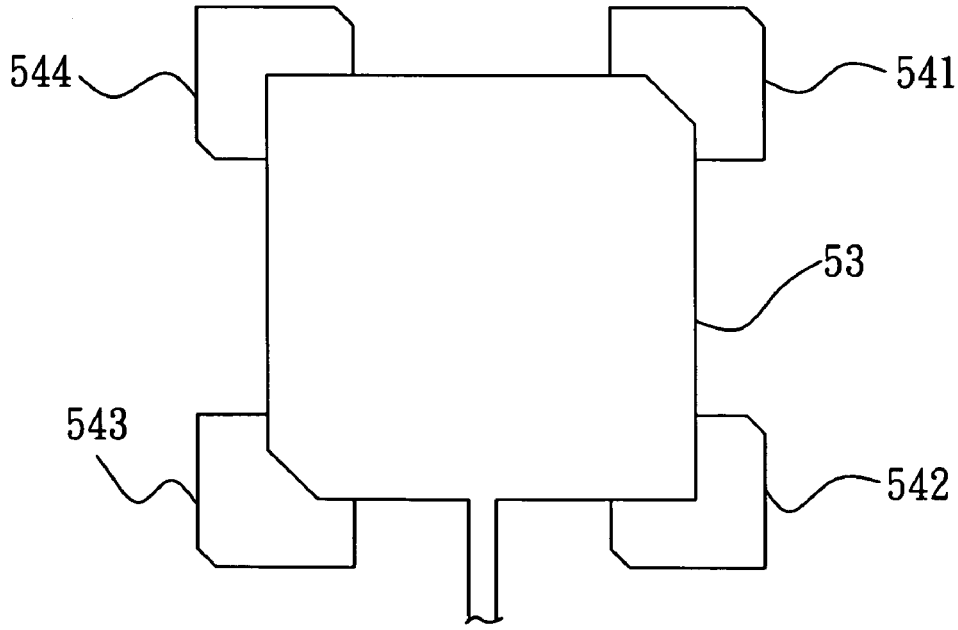
FIG. 5B is a schematic diagram of the dual-band circularly polarized antenna during its operation according to the third preferred embodiment of the present invention.

FIG. 5B is a schematic diagram of the dual-band circularly polarized antenna during its operation according to the third preferred embodiment of the present invention. The structure of the dual-band circularly polarized antenna during its operation according to the third preferred embodiment of the present invention is similar to that of the dual-band circularly polarized antenna according to the first preferred embodiment of the present invention. In the dual-band circularly polarized antenna during its operation according to the third preferred embodiment of the present invention, the first polarized radiating element 53 is 72 mm long and 72 mm wide, and the four second polarized radiating elements 541, 542, 543, 544 share the identical size of 27 mm in length and 27 mm in width.

As shown in FIG. 5B, the first polarized radiating element 53 and the four second polarized radiating elements 541, 542, 543, 544 thereunder are all chamfered, such that the first bevel (the bottom left and the upper right corners of the first polarized radiating elements 53, being located on the first diagonal are chamfered) is parallel to the second bevels (the bottom left and the upper right corners of each of the four second polarized radiating elements 541, 542, 543, 544, being located on the second diagonal are chamfered).

Therefore, the dual-band circularly polarized antenna according to the third preferred embodiment of the present invention can transmit the first circularly polarized signals with the right-handed circularly polarization (the frequency of which is approximate to 900 MHz) and the second circularly polarized signals (the frequency of which is approximate to 2.45 GHz) with the right-handed circularly polarization simultaneously in its transmitting state. Also, when the dual-band circularly polarized antenna according to the third preferred embodiment of the present invention is in its receiving state, it can receive either the first circularly polarized signals or the second circularly polarized signals transmitted in the ambient environment. Moreover, after executing certain signal processing steps, the dual-band circularly polarized antenna according to the third preferred embodiment of the present invention can even receive both the first circularly polarized signal or the second circularly polarized signal simultaneously.

Figure 5C:
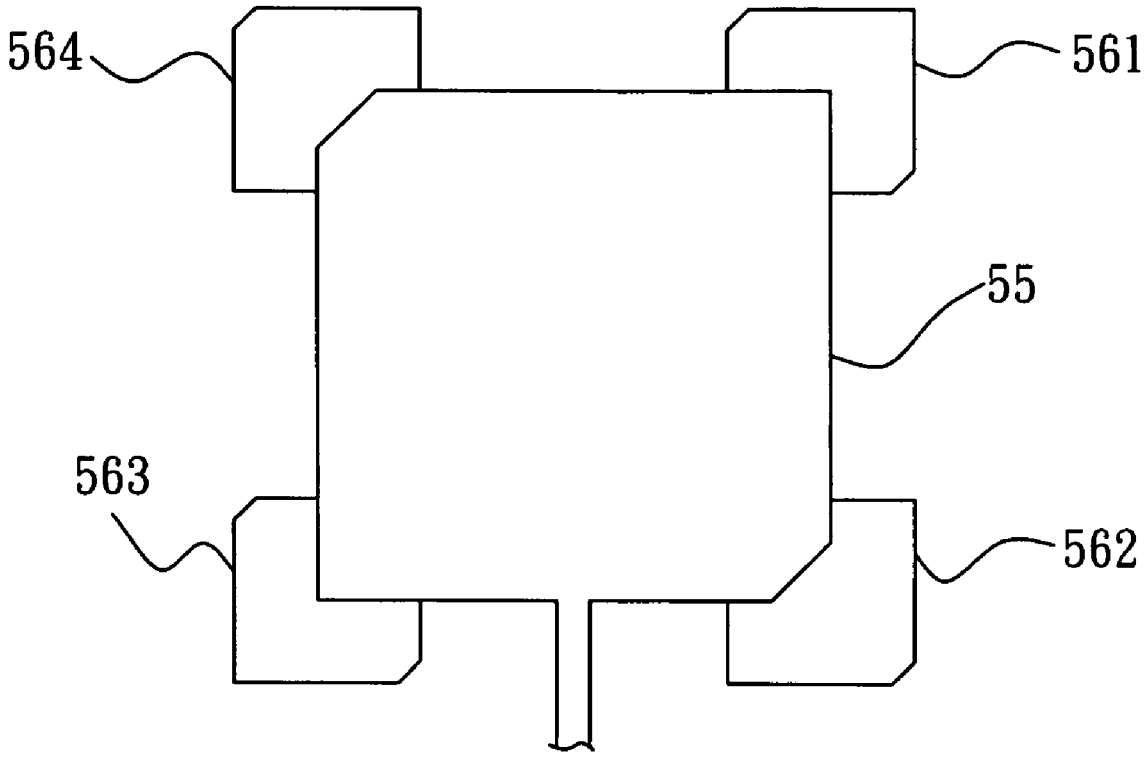
FIG. 5C is a schematic diagram of the dual-band circularly polarized antenna during its operation according to the fourth preferred embodiment of the present invention.

FIG. 5C is a schematic diagram of the dual-band circularly polarized antenna during its operation according to the fourth preferred embodiment of the present invention. The structure of the dual-band circularly polarized antenna during its operation according to the fourth preferred embodiment of the present invention is similar to that of the dual-band circularly polarized antenna according to the first preferred embodiment of the present invention. In the dual-band circularly polarized antenna during its operation according to the fourth preferred embodiment of the present invention, the first polarized radiating element 55 is 72 mm long and 72 mm wide, and the four second polarized radiating elements 561, 562, 563, 564 share the identical size of 27 mm in length and 27 mm in width.

As shown in FIG. 5C, the first polarized radiating element 55 and the four second polarized radiating elements 561, 562, 563, 564 thereunder are all chamfered, such that the first bevel (the bottom right and the upper left corners of the first polarized radiating elements 55, being located on the first diagonal are chamfered) is parallel to the second bevels (the bottom right and the upper left corners of each of the four second polarized radiating elements 561, 562, 563, 564, being located on the second diagonal are chamfered).

Therefore, the dual-band circularly polarized antenna according to the fourth preferred embodiment of the present invention can transmit the first circularly polarized signals with the left-handed circularly polarization (whose frequency is approximate to 900 MHz) and the second circularly polarized signals (whose frequency is approximate to 2.45 GHz) with the left-handed circularly polarization simultaneously in its transmitting state. Also, when the dual-band circularly polarized antenna according to the fourth preferred embodiment of the present invention is in its receiving state, it can receive either the first circularly polarized signals or the second circularly polarized signals transmitted in the ambient environment. Moreover, after executing certain signal processing steps, the dual-band circularly polarized antenna according to the fourth preferred embodiment of the present invention can even receive both the first circularly polarized signal or the second circularly polarized signal simultaneously.

Figure 6A:
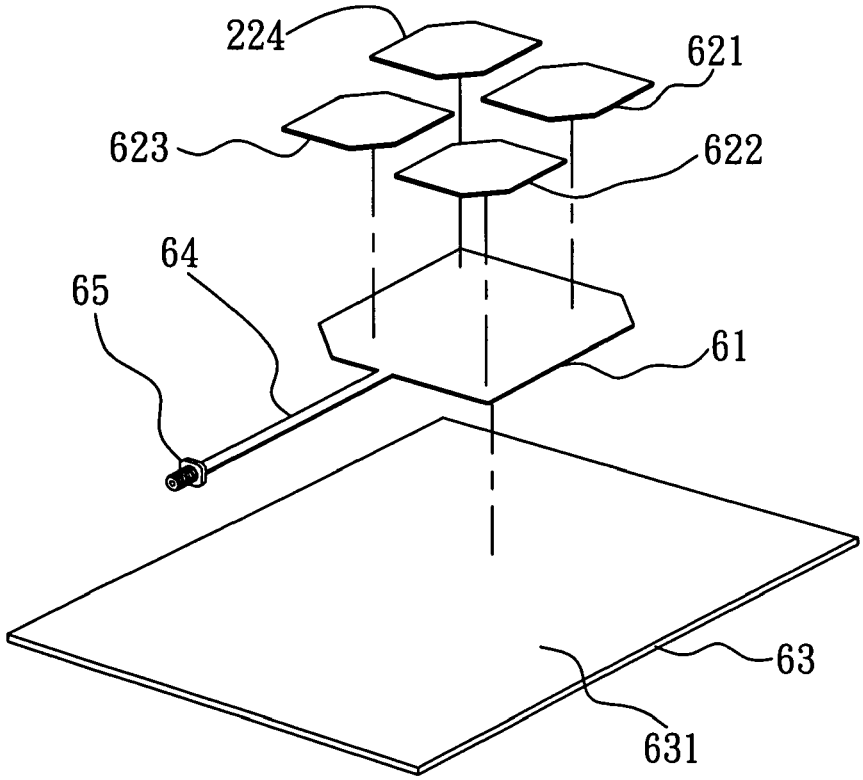
FIG. 6A is a perspective view of a dual-band circularly polarized antenna according to the fifth preferred embodiment of the present invention.

FIG. 6A is a perspective view of a dual-band circularly polarized antenna according to the fifth preferred embodiment of the present invention. The dual-band circularly polarized antenna according to the fifth preferred embodiment of the present invention comprises a first polarized radiating element 61, four second polarized radiating elements 621, 622, 623, 624 and a ground plate 63. For brevity, the first microwave substrate on where the first polarized radiating element 61 is formed and the second microwave substrate on where the second polarized radiating elements 621, 622, 623, 624 is formed are omitted in the figure.

To assemble the dual-band circularly polarized antenna according to the fifth preferred embodiment of the present invention, the second microwave substrate (not shown) shall first be placed on the surface of the first microwave substrate (not shown). Then, the first microwave substrate and the second microwave substrate are then placed on the upper surface 631 of the ground plate 63 made of metallic material. Both the first microwave substrate and the second microwave substrates are made of an FR-4 microwave substrate and have a thickness of 1.6 mm.

As shown in FIG. 6A, a straight-line shaped signal coupling unit 64 is electrically connected with the first polarized radiating element 61 and an adapter 65, and the dual-band circularly polarized antenna according to the fifth preferred embodiment of the present invention is electrically connected with a signal processing unit (not shown) by a coaxial cable (not shown) being attached to the adapter 65. Thus, the dual-band circularly polarized antenna according to the fifth preferred embodiment of the present invention can transform an electrical signal from the signal processing unit (not shown) into two circularly polarized signals, i.e. the first circularly polarized signal and the second circularly polarized signal, at two respective frequency bands. After the transformation, the two circularly polarized signals are transmitted into the ambient environment (i.e. the dual-band circularly polarized antenna according to the fifth preferred embodiment of the present invention is in its transmitting state). On the other hand, the first polarized radiating element and the second polarized radiating elements of the dual-band circularly polarized antenna according to the fifth preferred embodiment of the present invention can receive circularly polarized signals of any kind of frequency bands in the environment and transform the circularly polarized signals into corresponding electrical signals. The electrical signals are then provided to the signal processing unit (not shown) for subsequent signal processing steps (i.e. the dual-band circularly polarized antenna according to the fifth preferred embodiment of the present invention is in its receiving state).

Figure 6B:
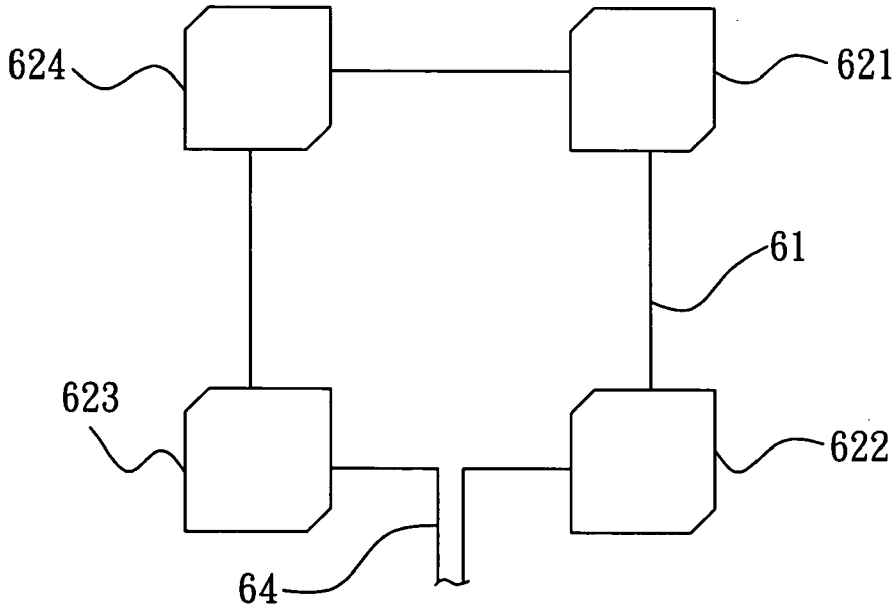
FIG. 6B is a schematic diagram of the dual-band circularly polarized antenna during its operation according to the fifth preferred embodiment of the present invention.

FIG. 6B is a schematic diagram of the dual-band circularly polarized antenna during its operation according to the fifth preferred embodiment of the present invention. The first polarized radiating element 61 is 72 mm long and 72 mm wide, and the four second polarized radiating elements 621, 622, 623, 624 share the identical size of 27 mm in length and 27 mm in width. As also shown in FIG. 6B, the four second polarized radiating elements 621, 622, 623, 624 and the first polarized radiating element 61 are all chamfered, such that the second bevels (the bottom right and the upper left corners of the four second polarized radiating elements 621, 622, 623, 624, being located on the second diagonal are chamfered) are perpendicular to the first bevel (the bottom left and the upper right corners of the first polarized radiating element 61, being located on the first diagonal are chamfered).

Therefore, the dual-band circularly polarized antenna according to the fifth preferred embodiment of the present invention can transmit the first circularly polarized signals with right-handed circularly polarization (the frequency of which is approximate to 900 MHz) and the second circularly polarized signals with the left-handed circularly polarization (the frequency of which is approximate to at 2.45 GHz) simultaneously in its transmitting state. Also, when the dual-band circularly polarized antenna according to the fifth preferred embodiment of the present invention is in its receiving state, it can receive either the first circularly polarized signal or the second circularly polarized signal transmitted in the ambient environment. Moreover, after executing certain signal processing steps, the dual-band circularly polarized antenna according to the fifth preferred embodiment of the present invention can even receive both the first circularly polarized signal or the second circularly polarized signal simultaneously.

In summary, by simply applying 'chamfered-corner treatment' on the corners of the first polarized radiating element and each of the second polarized radiating elements, the dual-band circularly polarized antenna of the present invention is able to transmit and receive the circularly polarized signals at two different frequency bands, i.e. the first circularly polarized signal and the second circularly polarized signal, at two different frequency bands at the same time.

Besides, by adjusting the side-length of the first polarized radiating element and each of the second polarized radiating elements of the dual-band circularly polarized antenna of the present invention, the frequency bands of the first circularly polarized signal and the second circularly polarized signal can be modulated. Further, the polarization direction (right-handed circularly polarized or left-handed circularly polarized) of the first circularly polarized signal and the second circularly polarized signal can also be modulated by choosing which of the corners of the first polarized radiating element and each of the second polarized radiating elements are to be chamfered, in order to meet the different performance requirements of different application circumstances.

Hence, by properly selecting the side-length and the corners to be chamfered of the first polarized radiating element and each of the second polarized radiating elements, the dual-band circularly polarized antenna of the present invention can not only transmit and receive two circularly polarized signals simultaneously at two different frequency bands, but also meet the different performance requirements of different application circumstances.

Additionally, for the application circumstances which the transmission and reception of two circularly polarized signals at different frequency bands is required, such as the antenna module of an RFID system, the dual-band circularly polarized antenna of the present invention can significantly simplify the structure and minimize the manufacturing cost thereof, especially compared with conventional solution, i.e., by using two single-band circularly polarized antennas operating at different frequency bands). Therefore, the dual-band circularly polarized antenna of the present invention can be easily integrated with any kind of antenna module of which the dimension is limited, and the application field of the dual-band circularly polarized antenna of the present invention is thus widened.

Although the present invention has been explained in relation to its preferred embodiment, it is to be understood that many other possible modifications and variations can be made without departing from the scope of the invention as hereinafter claimed.

What is claimed is:

1. A dual-band circularly polarized antenna comprising:

a first polarized radiating element having at least one chamfered corner;

a plurality of second polarized radiating elements, each of the second polarized radiating elements having at least one chamfered corner;

a signal distributor for distributing an electrical signal;

a signal coupling unit being electrically connected with the first polarized radiating element and the signal distributor respectively; and a ground plate;

wherein, as the dual-band circularly polarized antenna is in a transmitting state, the electrical signal is transmitted to the first polarized radiating element and the second polarized radiating elements by the signal distributor and the signal coupling unit therethrough, the first polarized radiating element and the second polarized radiating elements transform the electrical signal into a first circularly polarized signal and a second circularly polarized signal, respectively; as the dual-band circularly polarized antenna is in a receiving state, the first circularly polarized signal and the second circularly polarized signal are received by the first polarized radiating element and the second polarized radiating elements, and the first circularly polarized signal and the second circularly polarized signal are transformed into the electrical signal, the electrical signal is then transmitted through the signal coupling unit to the signal distributor.

2. The dual-band circularly polarized antenna as claimed in claim 1, wherein the quantity of the second polarized radiating elements is 4.

3. The dual-band circularly polarized antenna as claimed in claim 1, wherein each of the second polarized radiating elements is square-shaped.

4. The dual-band circularly polarized antenna as claimed in claim 1, wherein the first polarized radiating element is square-shaped.

5. The dual-band circularly polarized antenna as claimed in claim 1, wherein the signal coupling unit is a straight conducting wire.

6. The dual-band circularly polarized antenna as claimed in claim 1, wherein the two corners of the first polarized radiating element positioned at a first diagonal thereof are chamfered.

7. The dual-band circularly polarized antenna as claimed in claim 6, wherein the two corners of each second polarized radiating elements positioned at a second diagonal thereof are chamfered, and each second diagonal of each second polarized radiating element is extended parallel to one another.

8. The dual-band circularly polarized antenna as claimed in claim 7, wherein the first diagonal of the first polarized radiating element is extended parallelly to the second diagonals of the second polarized radiating elements.

9. The dual-band circularly polarized antenna as claimed in claim 1, wherein the second polarized radiating elements are formed on a second microwave substrate made of an FR-4 substrate.

10. The dual-band circularly polarized antenna as claimed in claim 9, wherein the signal coupling unit and the first polarized radiating element are formed on a first microwave substrate made of an FR-4 substrate.

11. The dual-band circularly polarized antenna as claimed in claim 10, wherein the first microwave substrate is placed in between the ground plate and the second microwave substrate.

12. The dual-band circularly polarized antenna as claimed in claim 10, wherein the second microwave substrate is placed in between the ground plate and the first microwave substrate.

13. The dual-band circularly polarized antenna as claimed in claim 1, wherein the ground plate is made of a metallic material.

14. The dual-band circularly polarized antenna as claimed in claim 1, wherein the signal distributor is electrically connected with a coaxial cable.

15. The dual-band circularly polarized antenna as claimed in claim 1, wherein the frequency of the first circularly polarized signal ranges from 830 MHz to 930 MHz.

16. The dual-band circularly polarized antenna as claimed in claim 1, wherein the second circularly polarized signal ranges from 2.45 GHz to 2.55 GHz.

* * * * *